US008156679B1

(12) United States Patent
Swan

(10) Patent No.: US 8,156,679 B1
(45) Date of Patent: Apr. 17, 2012

(54) ACCESSORY MODULE WITH INTEGRATED ELECTRONIC DEVICES

(76) Inventor: Richard E. Swan, E. Bridgewater, MA (US)

( * ) Notice: Subject to any disclaimer, the term of this patent is extended or adjusted under 35 U.S.C. 154(b) by 214 days.

(21) Appl. No.: 12/687,121

(22) Filed: Jan. 13, 2010

Related U.S. Application Data

(60) Provisional application No. 61/144,472, filed on Jan. 14, 2009.

(51) Int. Cl.
*F41A 15/00* (2006.01)

(52) U.S. Cl. ..... 42/124; 42/125; 42/126; 42/90; 33/263; 33/297; 33/299

(58) Field of Classification Search ..... 42/124, 42/125, 126, 90; 33/263, 297, 299
See application file for complete search history.

(56) References Cited

U.S. PATENT DOCUMENTS

| | | | |
|---|---|---|---|
| 1,428,655 | A | 9/1922 | Noske |
| 2,161,051 | A | 6/1939 | Humeston |
| 3,877,166 | A | 4/1975 | Ward |
| 4,845,871 | A | 7/1989 | Swan |
| 4,860,480 | A | 8/1989 | Ruger |
| 4,905,396 | A | 3/1990 | Bechtel |
| 5,155,915 | A | 10/1992 | Repa |
| 5,276,988 | A | 1/1994 | Swan |
| 5,606,818 | A | 3/1997 | Hardee |
| 5,669,173 | A | 9/1997 | Rodney, Jr. |
| 5,680,725 | A | 10/1997 | Bell |
| 6,295,754 | B1 | 10/2001 | Otterman et al. |
| 6,442,883 | B1 | 9/2002 | Waterman et al. |
| 6,449,893 | B2 | 9/2002 | Spinner |
| 6,490,822 | B1 | 12/2002 | Swan |
| 6,513,276 | B2 | 2/2003 | Mendoza-Orozco |
| 6,598,333 | B1 | 7/2003 | Randazzo et al. |
| 6,637,144 | B2 * | 10/2003 | Nelson et al. ..... 42/120 |
| 6,922,934 | B1 | 8/2005 | Huan |
| 6,931,778 | B1 | 8/2005 | Nelson et al. |
| D537,499 | S | 2/2007 | Swan |
| 7,272,904 | B2 | 9/2007 | Larue |
| 2004/0148842 | A1 | 8/2004 | Aalto et al. |
| 2006/0123686 | A1 | 6/2006 | Larue |
| 2006/0207156 | A1 | 9/2006 | Larue |
| 2008/0155876 | A1 | 7/2008 | Matthews et al. |
| 2008/0168696 | A1 | 7/2008 | Orne et al. |

(Continued)

OTHER PUBLICATIONS

TM 9-4931-710-14&P, Technical Manual, Operator, Organizational, Direct Support and General Support Maintenance Manual, Headquarters, Department of the Army, Aug. 1986.

*Primary Examiner* — J. Woodrow Eldred
(74) *Attorney, Agent, or Firm* — Barlow, Josephs & Holmes, Ltd.

(57) ABSTRACT

An accessory module is installed between a weapon accessory (optical sighting device) and its corresponding mounting interface. The accessory module includes a body having a lower surface which is configured and arranged to mate with the corresponding upper surface of the mounting interface and an upper surface that includes a seat that is configured and arranged to conform to and receive the outer surface of the weapon accessory. The accessory module includes electronic accessories, such as for example, a flashlight configured to emit visible white light, colored light and/or infrared light. Further, the accessory module may include laser devices therein such as a laser sight, an infrared laser for night vision targeting, or a laser range finder device. The accessory module may also be configured to include a taser and/or a compact video camera.

8 Claims, 10 Drawing Sheets

U.S. PATENT DOCUMENTS

2008/0178511 A1 7/2008 Storch et al.
2010/0071247 A1* 3/2010 Holmberg ..... 42/124
2010/0192448 A1* 8/2010 Darian ..... 42/84
2010/0229450 A1* 9/2010 Becker et al. ..... 42/90
2011/0030263 A1* 2/2011 Larsson et al. ..... 42/90
2011/0162251 A1* 7/2011 Houde-Walter ..... 42/146

* cited by examiner

ACCESSORY MODULE WITH INTEGRATED ELECTRONIC DEVICES

CROSS-REFERENCE TO RELATED APPLICATIONS

This application is related to and claims priority from earlier filed U.S. Provisional Patent Application No. 61/144,472, filed Jan. 14, 2009.

BACKGROUND OF THE INVENTION

The present invention relates generally to optical device mounts for use in connection with firearms and assault weapons. More specifically, the present invention relates to an accessory module that is received between an optical device and a mounting interface, wherein the accessory module includes integrated electronics, such as visible lights, infrared emitters, laser sighting devices, range finders, etc.

In the general field of combat and commercial weaponry, numerous add-on enhancements have become available for attachment to standard firearms thereby significantly upgrading the capability of the firearm. One area within the broad scope of available firearms that is of particular interest is the M16/M4 weapon system typically utilized in military or combat settings. Generally, the M16/M4 weapon includes a lower receiver, an upper receiver, a butt stock extending rearwardly from the upper and lower receivers and a barrel that is attached to the front of the upper receiver and extends in a forward direction. The barrel is held in position on the front of the upper receiver by a barrel nut that is threaded onto a barrel mount located on the front of the upper receiver. Most new models of the M16/M4 weapons also include a dovetail rail interface integrally formed along the top of the upper receiver. This interface rail provides a convenient mounting point for many of the available accessories for use with the M16/M4 firearm such as scopes, sighting devices, lasers and directed fire devices. Since this rail extends only along the upper receiver the interface is limited in length to the length of the receiver. The difficulty is that many military personnel have multiple sighting devices, in addition to a variety of lighting devices, accessory handgrips, etc. that could also be attached to the weapon for enhanced use of the weapon. In view of the broad range of add on accessories, there is often not enough space on the upper receiver to accommodate all of the accessories that the user may desire to use.

In an attempt to overcome the space limitations, various methods and means have been developed for interfacing add-on enhancements to firearms. For example, U.S. Pat. No. 4,845,871 discloses a quickly detachable interface means for modular enhancements. This allows accessories to be quickly attached or detached from the weapon as various needs arise. Similarly, U.S. Pat. No. 5,142,806 discloses a universal receiver sleeve having an upper interface portion with standard, universal dimensions and having a lower interface portion specific to a particular firearm. This sleeve provides additional rail space on the weapon to accommodate additional accessories. Another interface means is disclosed in U.S. Pat. No. 5,343,650 where an extended rigid interface frame with upper and lower rails is joined to a firearm receiver and extends forward about the firearm's barrel to a head assembly replacing the firearm's normal front sight. A weaver type interface return portion is provided below the barrel from the head assembly to the receiver. The distal end of the extended rigid frame receiver sleeve terminates in a front sight housing, which connects the upper and lower rails and provides an integrated space for advanced laser and sensor components, as well as the standard front sight bead. By locating the laser and lighting devices in this housing, they are taken off of the rail, which can now be used for other devices.

Despite the space limitations, there is an ever growing spectrum of available accessories relating to optics for sighting targets. There are many different types of optics for the many different and varied types of combat that a soldier may face. For example, there are high power optics for snipers and there are low power red dot optics for close combat. There are also combination optics, such as the Trijicon® ACOG® optic, which includes an optic with a smaller degree of magnification (1×-4×) in combination with a red dot reticule. In any event, each of these optics must be mounted to the dovetail rail using some type of mounting interface.

In addition to optical sighting devices, lights and laser are another category of accessories employed in conjunction with firearms. These types of accessories are typically mounted on the hand guards of the weapon on the sides or on the top of the hand guard toward the front sight. Often, since one of the accessories used on the upper rail is an optical sight, most other accessories end up blocking the sight when mounted on the upper rail. Further, each of these additional accessories also takes up valuable space on the available dovetail rails and limits the overall number of possible accessories that can be mounted thereto. As a result, soldiers often have to make choices about which types of accessories they will mount for particular missions because all of the desired accessories will simply not fit onto the available rail space on the weapon.

Accordingly, there is a need in the industry for novel mounting systems which will integrate different accessories so that they can be located in a single position on the rail system and thus reduces the amount of space required for mounting them onto the weapon.

BRIEF SUMMARY OF THE INVENTION

In this regard, the present invention provides an accessory module that is received between a weapon accessory, such as an optical sighting device, and a mounting interface, wherein the module includes integrated electronics, such as visible lights, infrared emitters, laser sighting devices, range finders, etc. In this regard, the present invention provides a unique accessory module that integrates several different electronic elements within generally the same footprint as the mounting interface.

While the present invention will be described in particular in connection with a Trijicon® ACOG® optical sight, as this is the initial configuration developed for implementation of the teachings of the invention, it should be appreciated by one skilled in the art, that the general concept of the invention is equally applicable to any type of weapon accessory and mount configuration.

Accordingly, in its most general embodiment, the present invention provides an accessory module that is configured and arranged to be installed between a weapon accessory and its corresponding mounting interface. The accessory module includes a body having a lower surface which interfaces and mates with the corresponding upper surface of the mounting interface and an upper surface that includes a seat which is configured and arranged to conform to the outer surface of the weapon accessory (optical sighting device). In some embodiments, the body may also include a socket therein that allows a mounting base found on some weapon accessories and optical sighting devices to pass through the body in order to engage with the upper surface of the mounting interface. In either case, the accessory module of the present invention is sandwiched between the weapon accessory or optical sighting device and the mounting interface.

The accessory module is configured to include one or more of a plurality of different electronic accessories that would normally be mounted onto the weapon as separate components. The accessory module may include visible or infrared lighting devices such as a flashlight, a light emitting diode (LED) flashlight or even two LED light elements on opposing sides of the module. These light elements can be configured to emit visible white light, colored light and/or infrared. Further, the light elements may be configured to operate in any number of modes including but not limited to continuous on, momentary on, high power, low power, strobe, etc. Further, the accessory module may include laser devices positioned therein such as a laser sight commonly deployed on many weapons, an infrared laser for night vision targeting, a range finder device. The accessory module may also be configured to include a taser and/or a compact video camera.

It is therefore an object of the present invention to provide an optical accessory module that provides for the integration of several different accessories into a single location on the rail system thus reducing the amount of space required for mounting them onto the weapon. It is a further object of the present invention to provide an accessory module that provides for the integration of several different accessories into a device that is received at a location between a weapon accessory (optical sighting device) and the mounting interface for the weapon accessory such that the entire assembly occupies a single position on the rail system thus reducing the amount of space required for collectively mounting them onto the weapon.

These, together with other objects of the invention, along with various features of novelty that characterize the invention, are pointed out with particularity in the claims annexed hereto and forming a part of this disclosure. For a better understanding of the invention, its operating advantages and the specific objects attained by its uses, reference should be had to the accompanying drawings and descriptive matter in which there is illustrated a preferred embodiment of the invention.

BRIEF DESCRIPTION OF THE DRAWINGS

In the drawings which illustrate the best mode presently contemplated for carrying out the present invention.

DETAILED DESCRIPTION OF THE INVENTION

Figure 1:
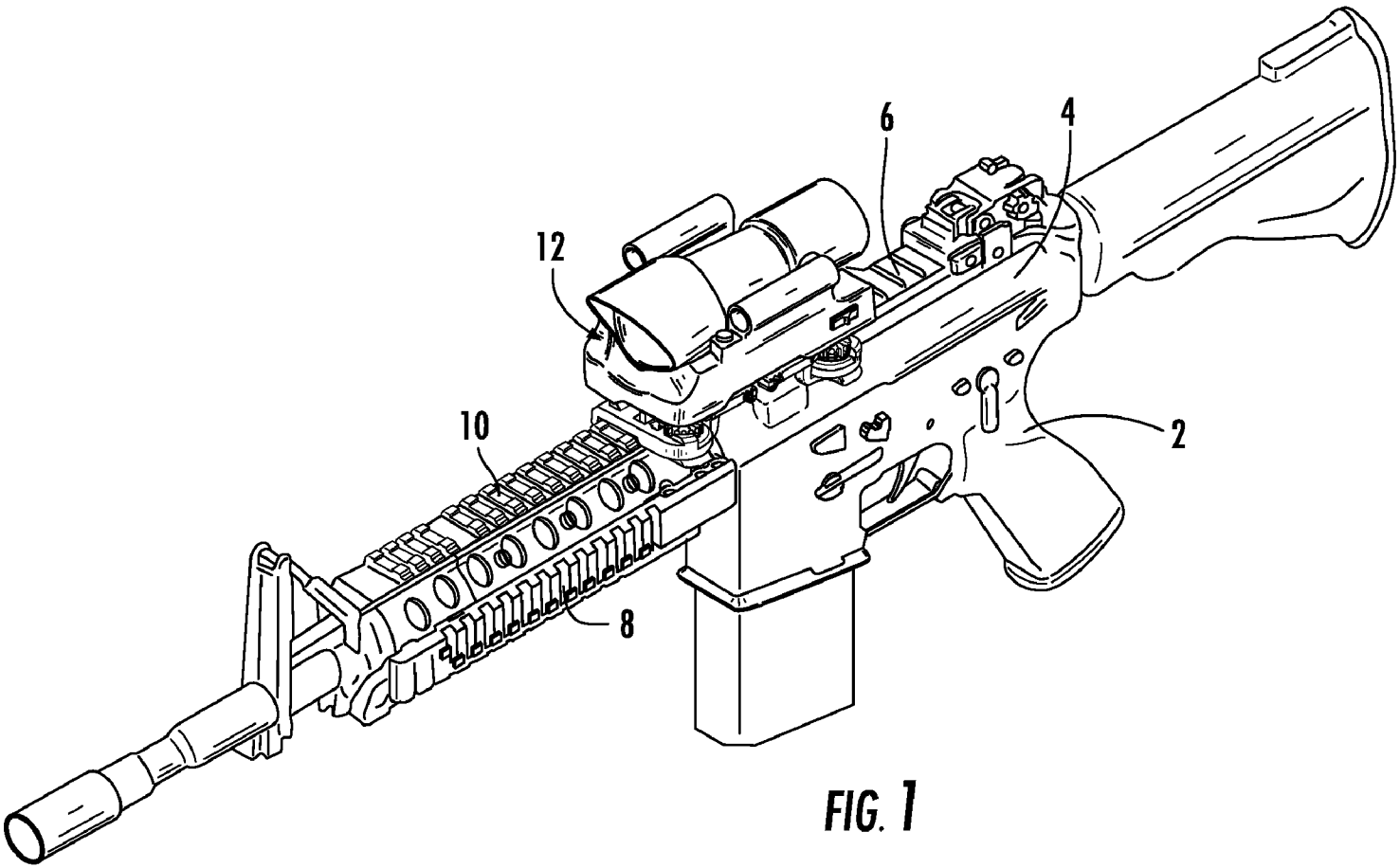
FIG. 1 is a front perspective view of the accessory module of the present invention shown as mounted on a firearm.

Now referring to the drawings, the accessory module is shown and generally illustrated in the figures. As can be seen, the accessory module of the present invention is generally configured to positioned between an optical sight (also generally identified as a weapon accessory) and a mounting interface as are traditionally employed combat firearms in a manner that allows various accessories to be positioned such that they do not interfere with the operation of other rail mounted accessories and so that they do not occupy any additional rail mounting space.

Figure 2:
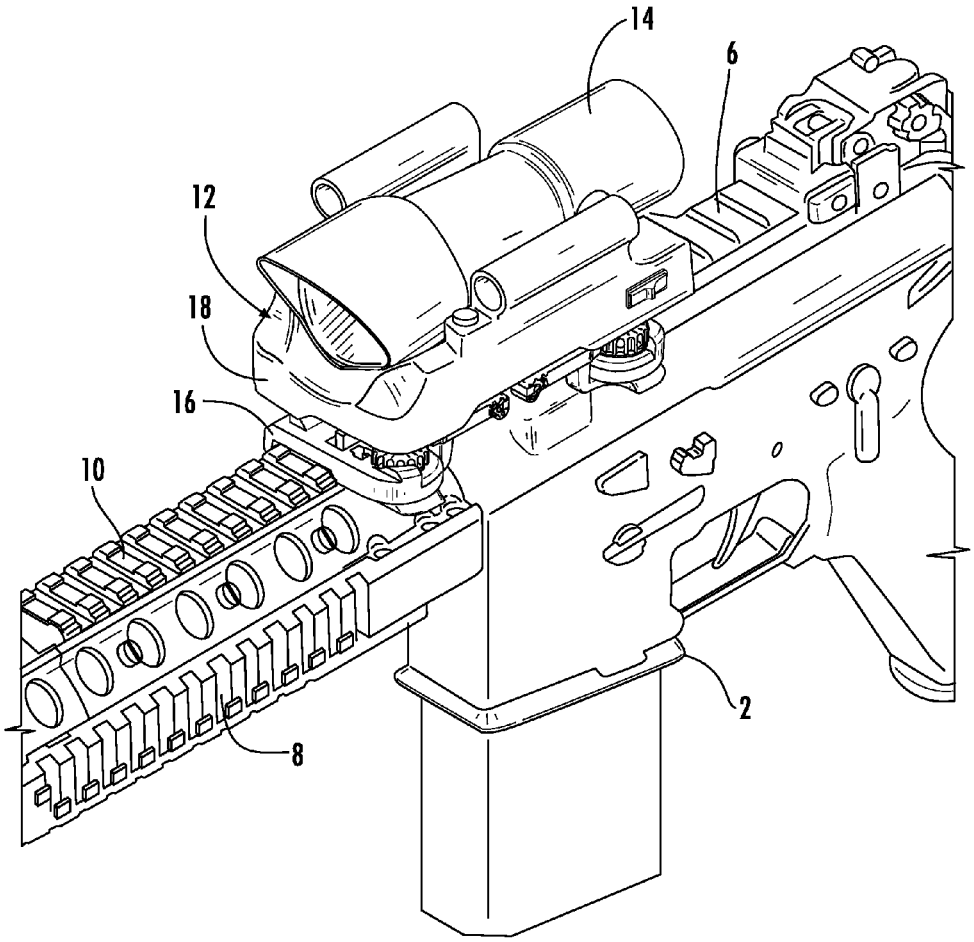
FIG. 2 is an enlarged perspective view of the accessory module of the present invention as mounted on a firearm.

Turning now to FIGS. 1-2, a combat firearm 2 is depicted here in the form of an M4 carbine such as the type employed by the US military. The firearm 2 includes an upper receiver 4 with a dovetail rail 6 that extends along its upper surface. Further a hand guard assembly 8 can be seen extending from the front of the upper receiver 4 to the front sight of the firearm 2. The hand guard assembly 8 can also be seen to include a standard dovetail rail 10 that extends longitudinally between its forward end and its rearward end. The upper hand guard has left and right side walls that extend generally outwardly and downwardly from the dovetail rail 10 to receive a lower hand guard such that the upper and lower hand guards cooperate to form a substantially tubular enclosure around the barrel of the firearm 2.

In the context of the illustrated embodiment, the accessory module 12 of the present invention is formed as an accessory module that is received between an optical sighting device 14 and a mounting interface 16, wherein the accessory module 12 includes integrated electronics, such as visible lights, infrared emitters, laser sighting devices, range finders, etc. In this regard, the present invention provides a unique accessory module 12 that integrates several different electronic elements within generally the same footprint as the mounting interface 16.

While the present invention will be described in particular in connection with a Trijicon® ACOG® optical sight, as this is the initial configuration developed for implementation of the teachings of the invention, such disclosure is not intended to be limiting on the scope of the present invention. It should be appreciated by one skilled in the art that the general concept of the invention is equally applicable to any type of weapon accessory, such as a laser sight, magnifier, light, optic, etc.

Figure 3:
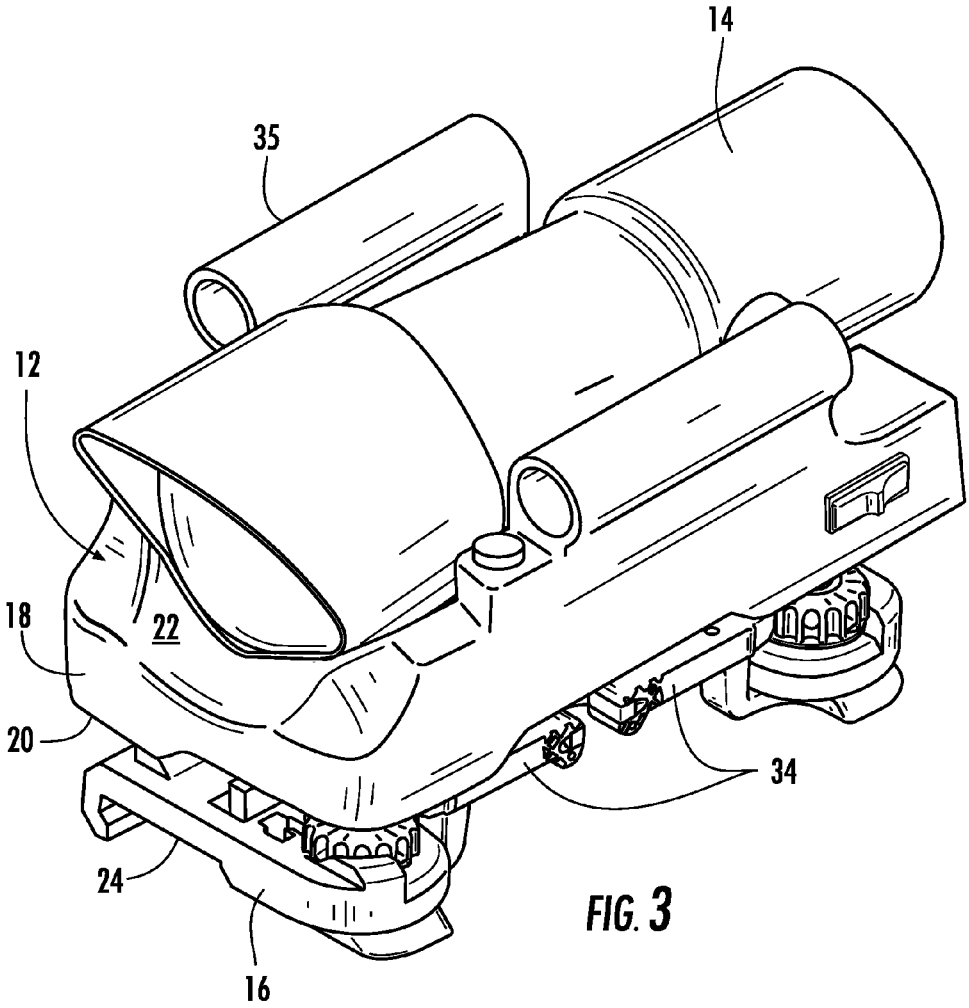
FIG. 3 is a front perspective view of the accessory module of the present invention.

Accordingly, as can be seen in FIGS. 1-3, in its most general embodiment, the present invention provides an accessory module 12 that is configured and arranged to be installed between a weapon accessory, i.e. optical device 14 and a corresponding mounting interface 16. The accessory module 12 includes a body 18 having a lower surface 20 which is configured and arranged to interface with the corresponding upper surface of the mounting interface 16 and an upper surface 22 that includes a seat having a surface which is configured and arranged to conform to the outer surface of the optical device 14. The mounting interface 16 in turn has a lower surface 24 that is configured to releasably engage the standard dovetail rails 6, 10 interface found on the firearm 2 and/or upper and lower hand guard assembly. In this manner, the optical device 14, accessory module 12 and the mounting interface 16 are all interconnected into a single mounting module that is received and retained on the dovetail rail without requiring any more space that would have been required using the prior art weapon accessory 14 and mounting interface 16.

Figure 4:
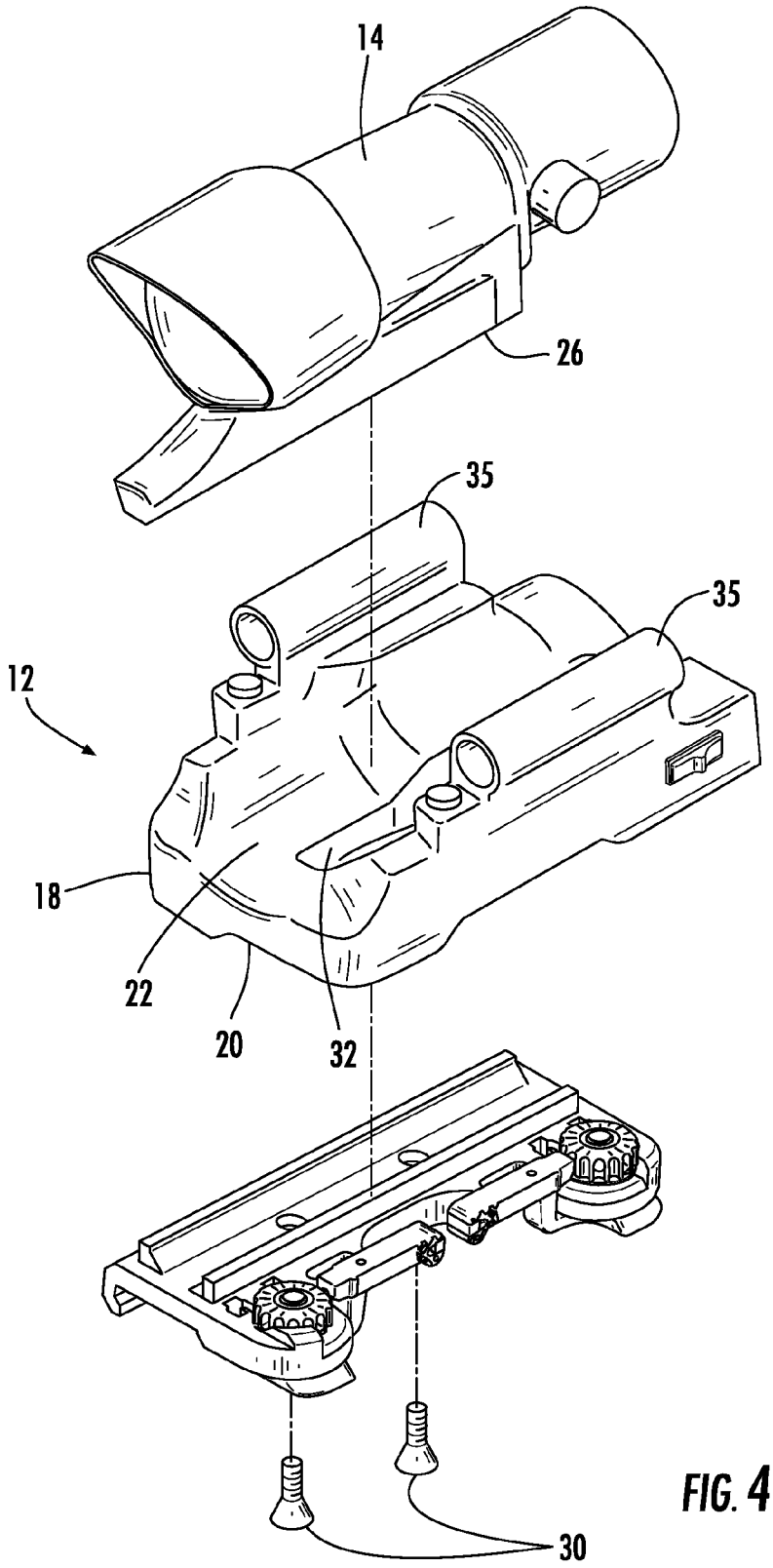
FIG. 4 is an exploded perspective view of the accessory module of the present invention.
Figure 5:
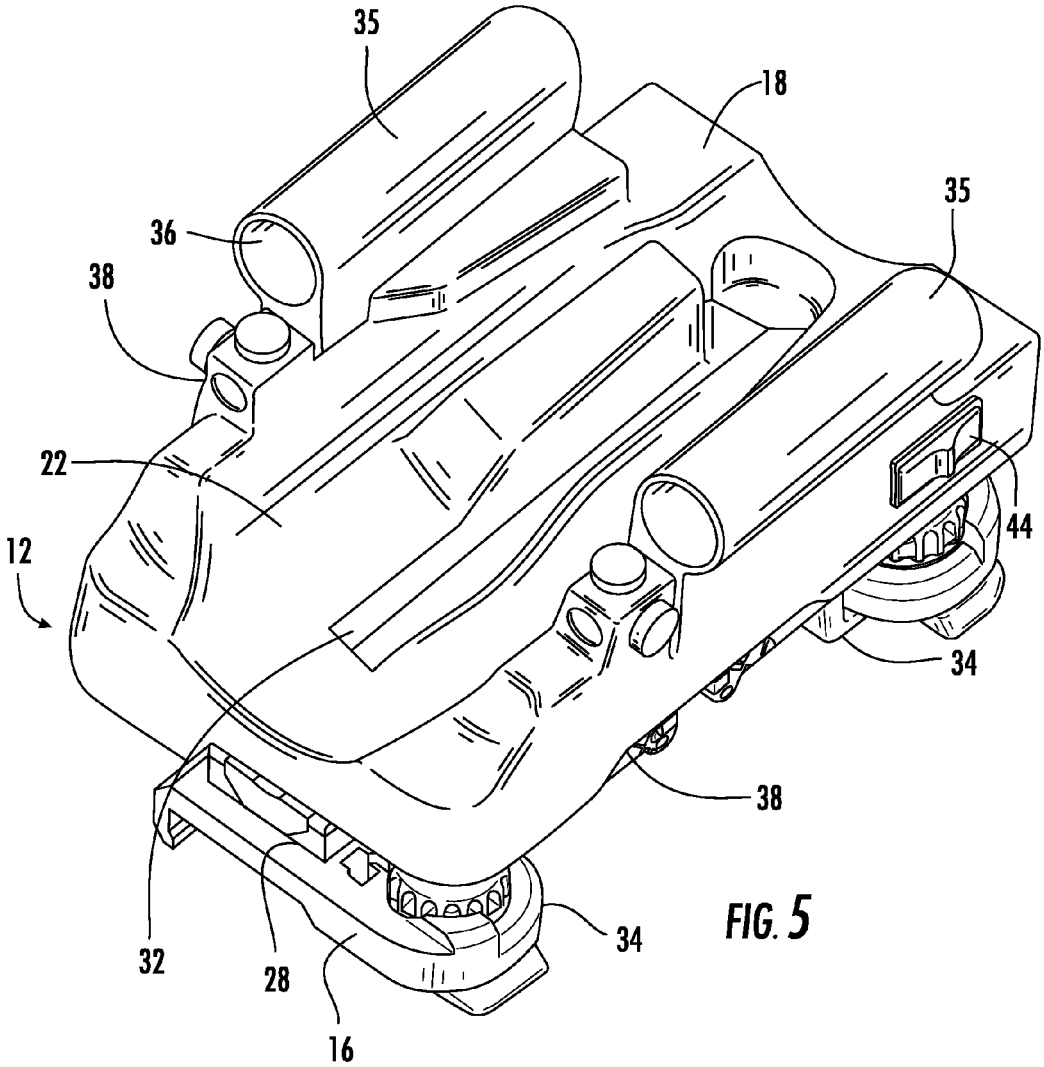
FIG. 5 is a front perspective view of the accessory module of the present invention with the optic removed.

Turning now to FIGS. 4 and 5, the optical sight (weapon accessory) 14, depicted here as an ACOG® sight includes a body with an outer surface that is contoured and a lower surface (mounting base) 26 that is configured for mounting of the optic 14 to the upper surface 28 of the mounting interface 16. For example, the mounting interface 16 is illustrated herein as an A.R.M.S.® #19 mount. This mounting interface 16 is specifically designed for receiving and retaining the ACOG® sight 14. In the prior art, the optical device 14 is secured to the mounting interface 16 using one or more screws (fastening mechanisms) 30 that are inserted through the bottom of the mounting interface 16 and received into the mounting base 26 of the optical device 14 thereby releasably securing the optical device 14 and the mounting interface 16 together as a single unit.

As can be seen, the accessory module 12 of the present invention is configured and arranged to be received and retained between the weapon accessory (optical device) 14 and the mounting interface 16. The accessory module 12 includes a body portion 18 having a lower surface 20 that is configured and arranged to interfittingly mate with the corresponding upper surface 28 of the mounting interface 16 and an upper surface 22, which includes a seat having surface that is configured and arranged to conform to the outer surfaces of the respective optical device 14. When the pieces are assembled with the accessory module 12 received and retained between the optical device 14 and the mounting interface 16, the optical accessory module 12 is sandwiched between the optic 14 and the mount 16. It should be appreciated that the body 18 of the accessory module 12 and its upper and lower surfaces may be shaped and contoured to match any desired weapon accessory 14, as well as any of the desired dovetail mounting interfaces 16 or any other type of mount.

In the embodiment as illustrated, the body 18 of the accessory module 12 also includes a socket 32 therein that allows the mounting base 26 to pass through the body 18 in order to engage directly with the upper surface 28 of the mounting interface 16. In either case, the body 18 of the accessory module 12 of the present invention is sandwiched between the optic 14 and the mounting interface 16.

Other configurations (not shown) could include embodiments where the weapon accessory 14 is secured to the accessory mount 12 using one set of fasteners, and the mounting interface 16 is secured to the accessory mount 12 using another separate set of screws 30 (as shown).

Figure 6:
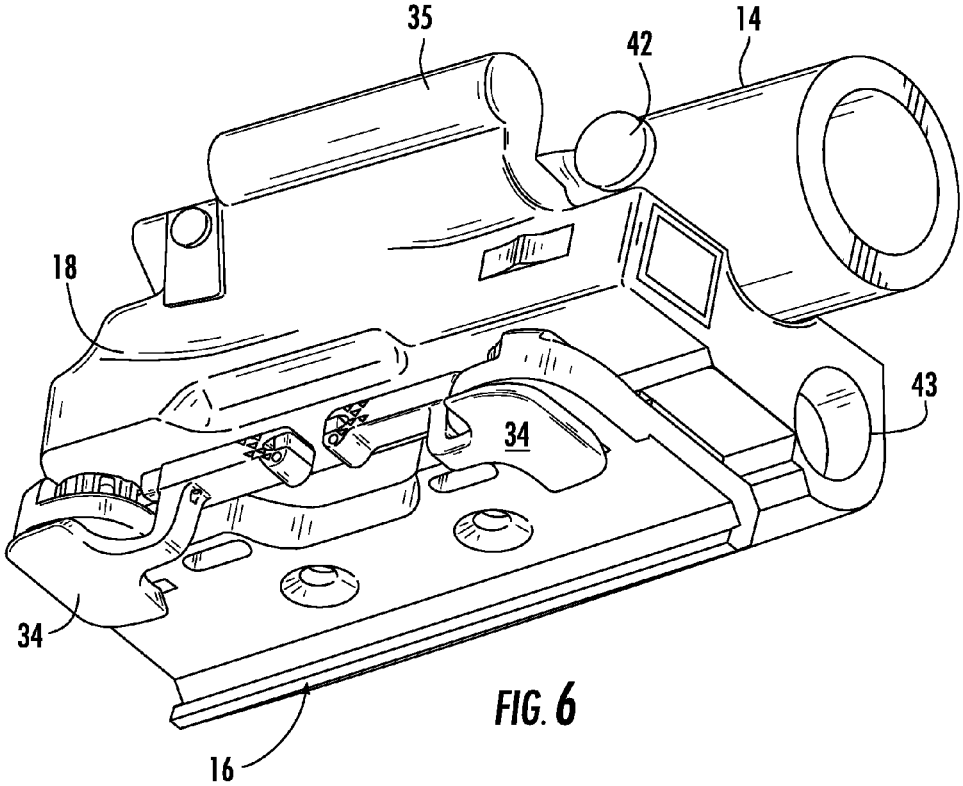
FIG. 6 a bottom perspective view of the accessory module of the present invention.
Figure 7:
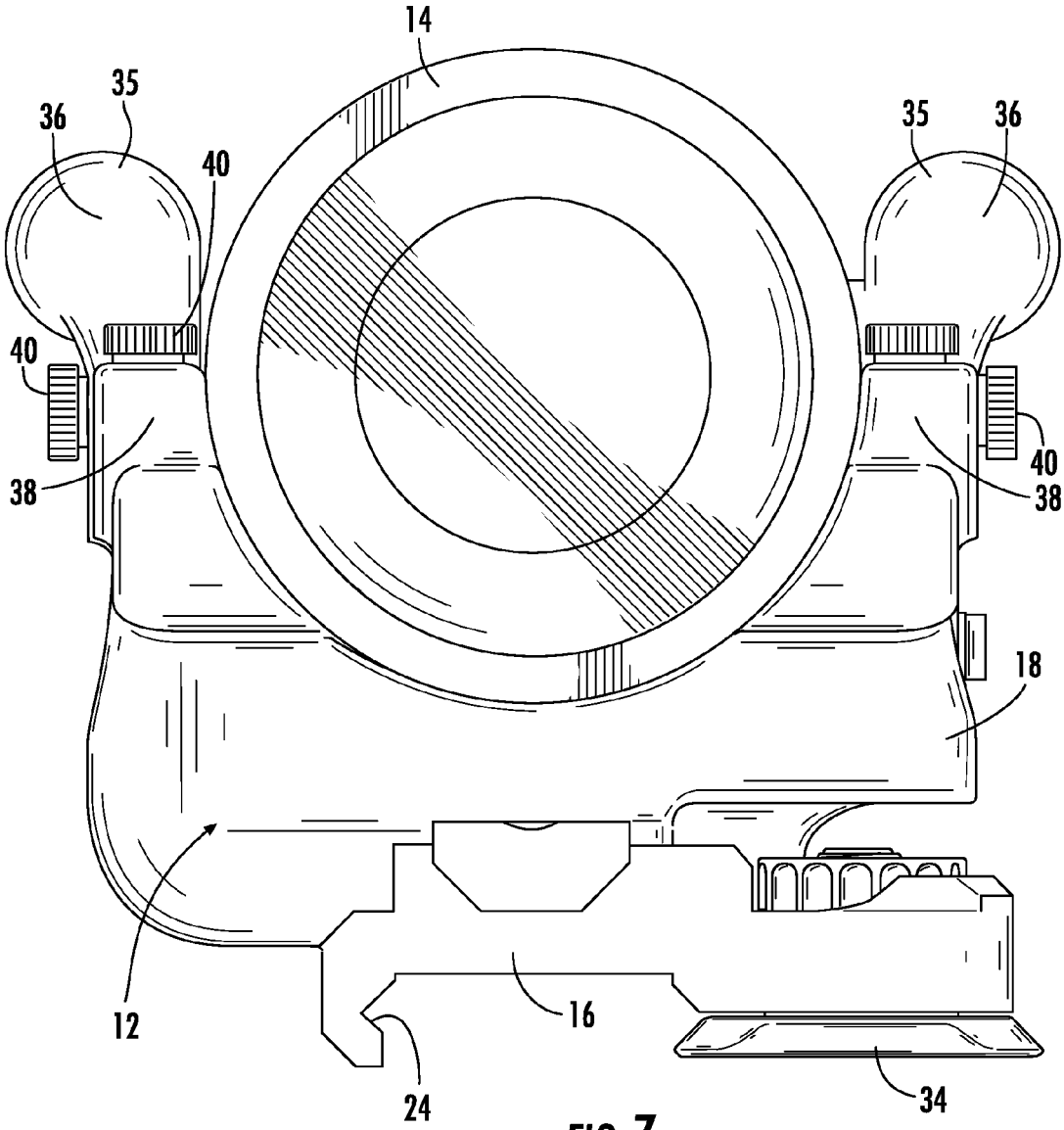
FIG. 7 is a front view of the accessory module of the present invention.

Turning to FIG. 6, the lower side of the mounting interface 16 includes a dovetail interface and two opposing locking assemblies 34 for releasably securing the mounting interface 16 to the dovetail rails 6, 10 on the top of the weapon 2 or hand guard assembly 8. The locking assemblies 34 are preferably Throw Lever® locking assemblies as manufactured by A.R.M.S. Inc.

The accessory module 12, as illustrated at FIGS. 7-10 is configured to include a plurality of different electronic accessories that would normally be mounted onto the weapon as separate components. The accessory module includes at least one optical accessory such as a flashlight, laser or camera. More particularly, the accessory module 12 can be seen to include one or more wings 35 such that the wings 35 extend upwardly from the body 18 of the accessory module 12. Within the wings 35, the accessory module may include visible or infrared lighting devices such as a flashlight 36, a light emitting diode (LED) flashlight or even two LED light elements in left and right wings 35 on opposing sides of the optic 14. These light elements 36 can be configured to emit visible white light, colored light and/or infrared. Further, the light 36 may be configured to operate in any number of modes including but not limited to continuous on, momentary on, high power, low power, strobe, etc. Instead of or in addition to the light elements, the accessory module 12 may include laser devices 38 positioned therein such as a laser aiming sight commonly deployed on many weapons, an infrared laser for night vision targeting, or a laser range finder device. Further, the accessory module 12 may be configured to include a taser and/or a compact video camera. It can be seen that where an aiming laser 38 is provided, windage and elevation adjustment knobs 40 are provided to allow adjustment and alignment of the targeting devices.

Figure 8:
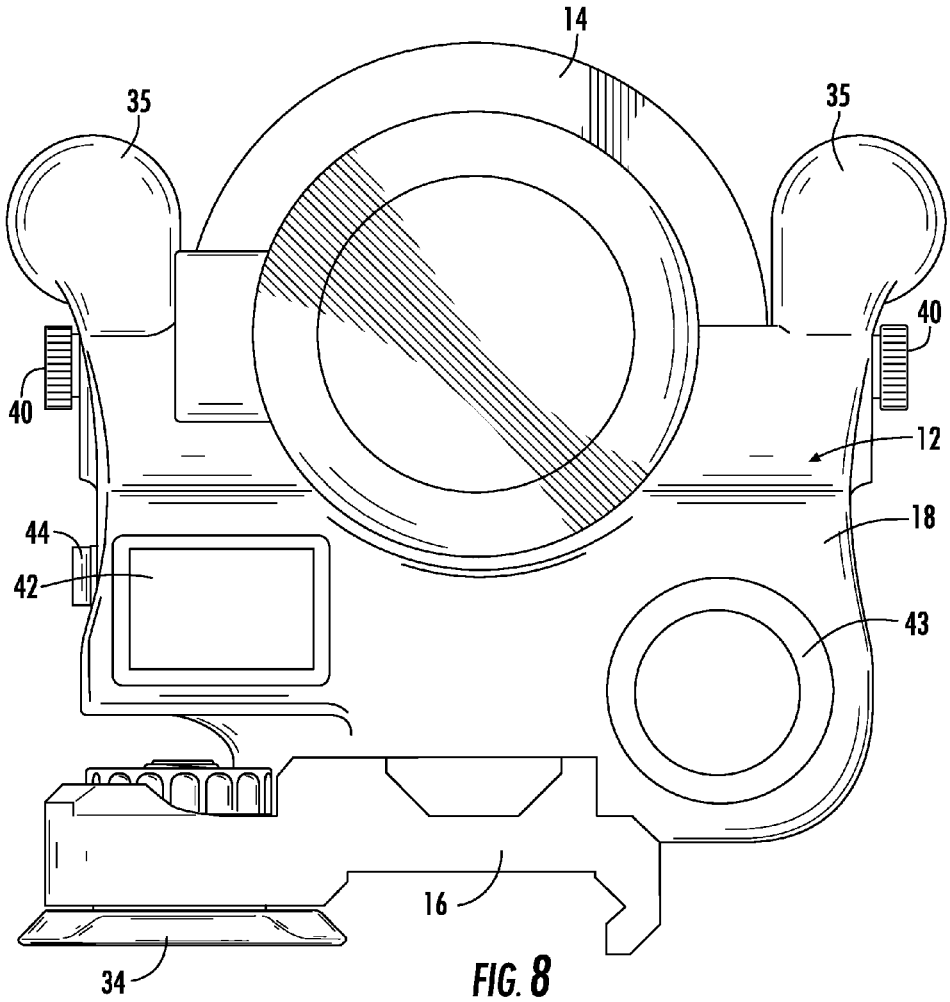
FIG. 8 is a rear view of the accessory module of the present invention.

As can best be seen in FIG. 8 an accessory in the form of an IR laser could be integrated with range finder device. It can be seen that where a range finder is provided, an LCD display 42 is provided on the rear surface of the accessory body 18 to visibly display range as measured by the range finder to the user of the weapon. This closely spaced integration of lights, lasers and range information is highly desirable as it does not require the user to stray their line of sight to utilize any or all of the component accessories. The location of the range finder display 42 is ideal as it is already in the line of sight when using the optic. In FIGS. 6 and 8, it can be seen that the accessory module body 18 includes a power source 43, such as on board batteries.

Figure 9:
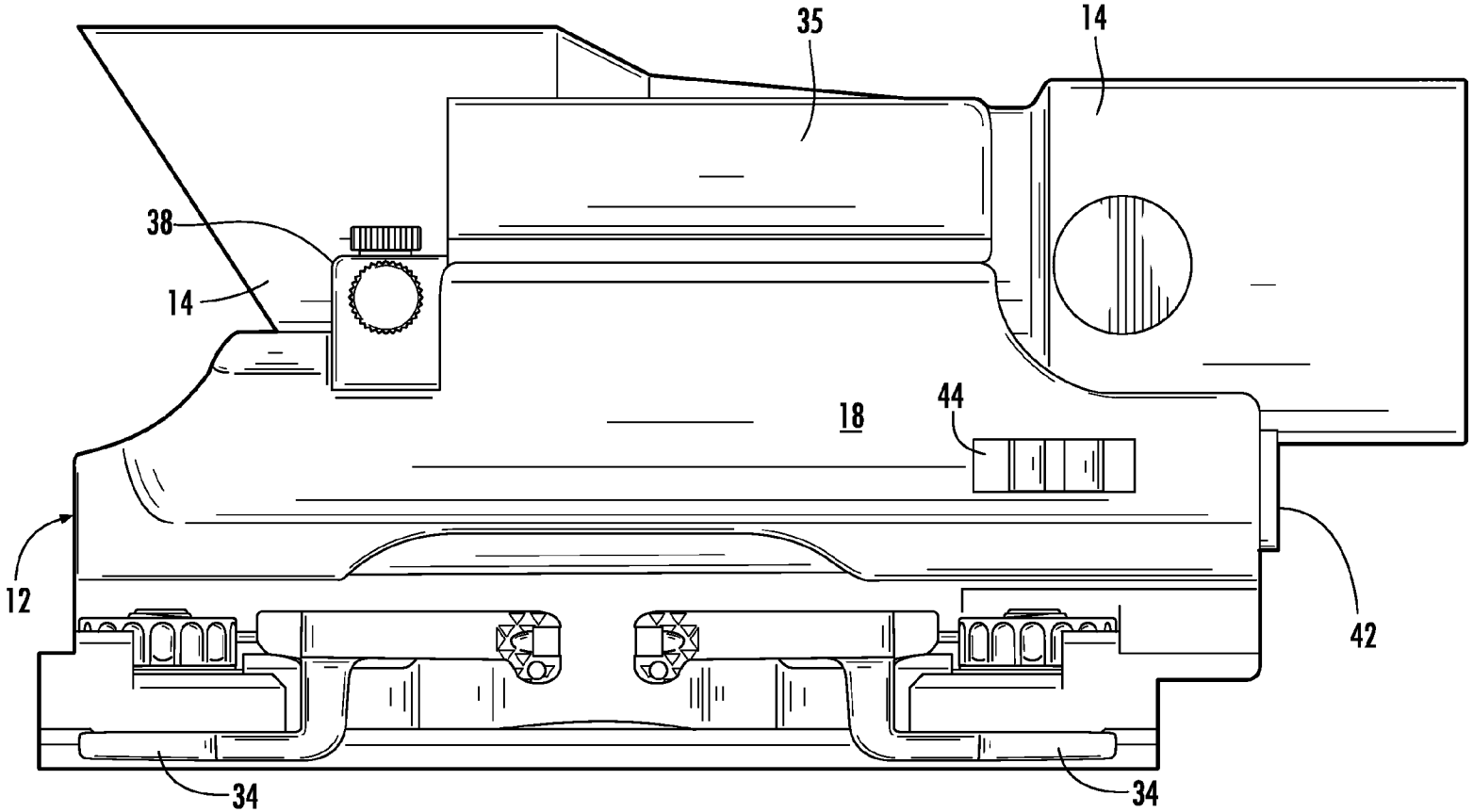
FIG. 9 is a left side view of the accessory module of the present invention.
Figure 10:
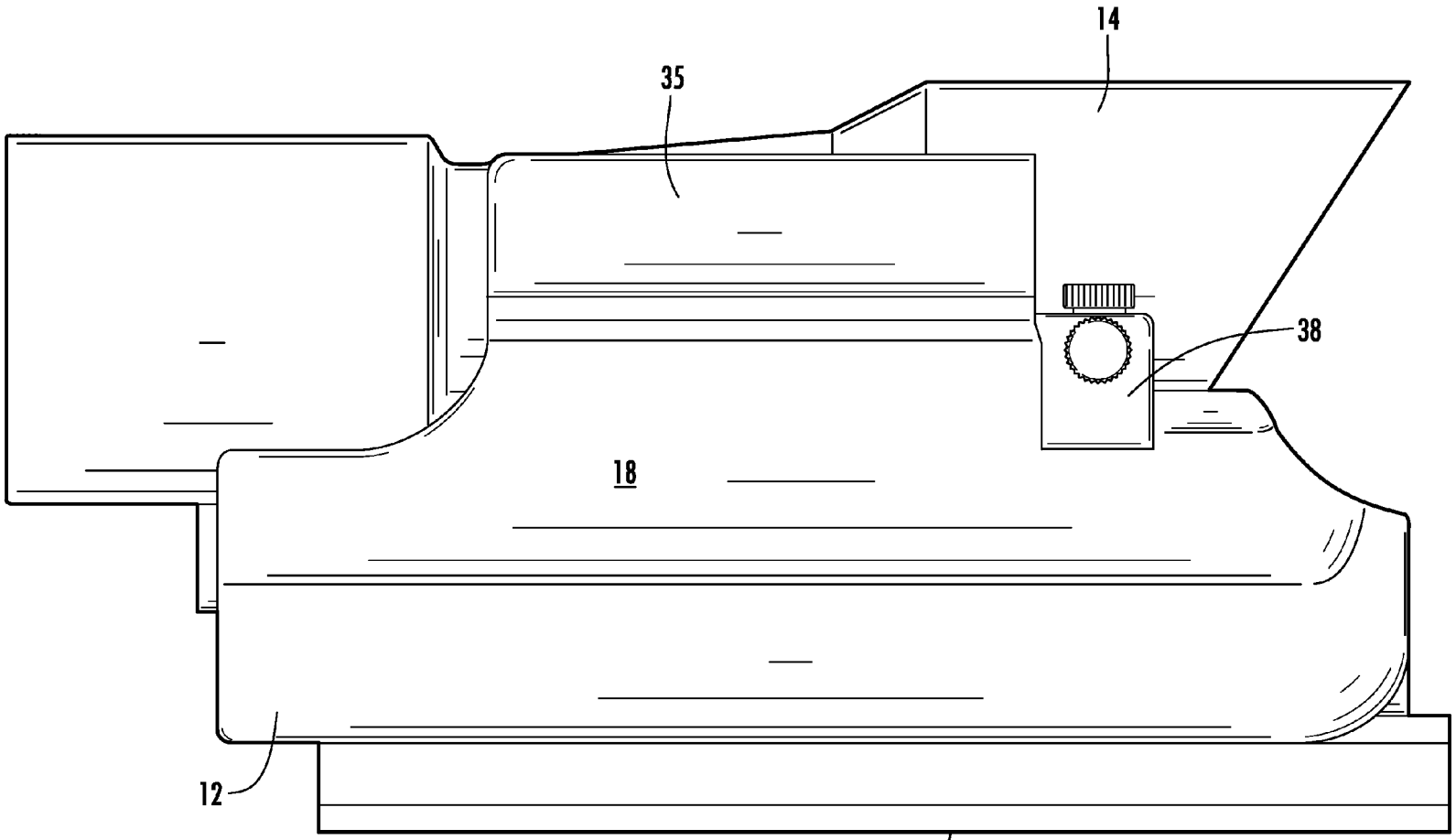
FIG. 10 is a right side view of the accessory module of the present invention.

At FIGS. 5 and 9, a switch 44 can be seen to allow the user to selectively operate one or all of the optical accessories individually or in combination with one another as required.

It is important to note that the inventive concept taught within the context of the present invention is generally the provision of an accessory module having a body with a lower surface configured to conform to the desired mounting interface, and an upper surface contoured and configured to conform to the outer shape of the desired weapon accessory. This particular arrangement as an accessory sandwiched between the accessory and the mounting interface is important in the context of marketing to the current consumer. Most users of a particular sighting device or accessory already own the associated mounting interface for that accessory. It is a key marketing feature for existing consumers that the accessory module as described herein be capable of use with the existing accessory and mounting interface already owned by the end user. This unique arrangement of having the accessory module sit between the existing parts allows the end user to purchase upgraded functionality for use with existing equipment. It also allows the military to retrofit existing weapon accessory systems with upgraded functionality without replacing the existing equipment.

Alternatively, although no embodiment is shown, it is contemplated that the accessory module 12 and the mounting interface may be integrated into a single unit for new products where, the electronic accessories as identified herein would be integrated into the body of the mounting interface. In this context, the integration of the various electronic components can take on many configurations as desired by the end users. Optimal configurations will be developed according to market desired and practical needs.

Therefore, it can be seen that the present invention provides an accessory module that facilitates the integration of several different accessories into a single position on the rail system in a manner that reduces the amount of space required for mounting them onto the weapon. Further, the present invention provides an accessory module that provides for the integration of several different accessories into a device that is received at a location between an optical device and the mount interface for the device such that the entire assembly occupies a single position on the rail system in a manner that reduces the amount of space required for mounting them onto the weapon. For these reasons, the instant invention is believed to represent a significant advancement in the art, which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed:

1. An electronic lighting accessory for use in an optical sighting system including an optical sighting device and a mounting interface, said optical sighting device having an outer surface and a mounting base, said mounting interface including a lower surface configured and arranged to be received on a weapon platform, a locking assembly configured and arranged to selectively lock said mounting interface to said weapon platform, an upper surface configured and arranged to receive the mounting base of the optical sighting device, and a fastening mechanism configured and arranged to fasten the optical sighting device to the mounting interface, the accessory comprising:

a body having a lower surface configured and arranged to be received in interferfitting mated relation with the upper surface of the mounting interface and an upper surface having a seat configured and arranged to receive the outer surface of the optical sighting device in interfitting mated relation, said body including a socket extending through said body between said upper surface and said lower surface such that said mounting base of said optical sighting device passes through said socket to engage said upper surface of said mounting interface; and at least one electronic accessory device contained within said body.

2. The electronic lighting accessory of claim 1, wherein said at least one electronic accessory device is selected from the group consisting of: a visible light, an infrared illuminator, a laser, and a laser range finder.

3. An accessory module for use in a weapon accessory mounting system including a weapon accessory and a mounting interface, said weapon accessory having an outer surface, said mounting interface including a lower surface configured and arranged to be received on a weapon platform, a locking assembly configured and arranged to selectively lock said mounting interface to said weapon platform, an upper surface configured and arranged to receive the weapon accessory, and a fastening mechanism configured and arranged to fasten the weapon accessory to the mounting interface, the accessory module comprising:

a body having a lower surface configured and arranged to be received in interferfitting mated relation with the upper surface of the mounting interface and an upper surface having a seat configured and arranged to receive the outer surface of the weapon accessory in interfitting mated relation; and at least one electronic accessory device contained within said body.

4. The electronic accessory module of claim 3, wherein said at least one electronic accessory device is selected from the group consisting of: a visible light, an infrared illuminator, a laser, and a laser range finder.

5. The electronic lighting accessory of claim 1, further comprising:

a power supply contained within said body; and a switch configured and arranged to selectively energize said at least one accessory device.

6. The electronic lighting accessory of claim 1, wherein said at least one accessory is a laser rangefinder, said laser range finder including a display positioned on a rear surface of said body to display a range determined by said laser range finder.

7. The accessory module of claim 3, further comprising:

a power supply contained within said body; and a switch configured and arranged to selectively energize said at least one accessory device.

8. The accessory module of claim 1, wherein said at least one accessory is a laser rangefinder, said laser range finder including a display positioned on a rear surface of said body to display a range determined by said laser range finder.

* * * * *